United States Patent [19]

Straitz, III

[11] 4,090,840

[45] May 23, 1978

[54] MULTI-PILOT GAS CONSERVATION SYSTEM FOR FLARE BURNERS

[75] Inventor: John F. Straitz, III, Meadowbrook, Pa.

[73] Assignee: Combustion Unlimited Incorporated, Elkins Park, Pa.

[21] Appl. No.: 796,016

[22] Filed: May 11, 1977

[51] Int. Cl.[2] ..... F23N 5/18

[52] U.S. Cl. ..... 431/14; 431/75; 431/60; 431/202

[58] Field of Search ..... 431/15, 16, 18, 60, 431/75, 202

[56] References Cited

U.S. PATENT DOCUMENTS 3,822,985 7/1974 Straitz ..... 431/202

FOREIGN PATENT DOCUMENTS 503 1/1915 Netherlands ..... 431/75

*Primary Examiner*—Carroll B. Dority, Jr.
*Attorney, Agent, or Firm*—Zachary T. Wobensmith, 2nd; Zachary T. Wobensmith, III

[57] ABSTRACT

A multiple pilot system is shown for ignition of waste gas from a flare burner, provisions being made to reduce or limit the pilots for ignition at the most effective location as determined by the wind direction and further, if desired by the wind velocity, the reduction in the number of pilots effecting substantial savings of combustible gas. Provision is made for emergency supply of gas to the pilots as desired.

16 Claims, 6 Drawing Figures

TEMP LIMIT SWITCH
#1 MOTOR VALVE
SPARK
TRANSF
REMOTE ALARM
GAS
AIR
MV
TC
SV
NC
NO
CR
CR #1
CR #2
CR #3

TCC
TC
SV
SPARK
TRANSF
REMOTE ALARM
SPRING RETURN
57 SECONDS
10 SECONDS
TM
AIR
GAS

MULTI-PILOT GAS CONSERVATION SYSTEM FOR FLARE BURNERS

BACKGROUND OF THE INVENTION

1. Field of the Invention

This invention relates to a control system for ignitor pilots used with flare burners and more particularly to such a system for conserving pilot fuel.

2. Background of the Prior Art

It has heretofore been proposed to employ one or more pilots for igniting waste combustible gas delivered from a flare stack or burner.

Various systems have also been proposed for igniting the gas at the pilot.

The number of pilots for a particular stack has usually been dictated by the diameter of the stack. For stack diameters of two to four inches, a single pilot is customary. For stack diameters of about six inches, two pilots, disposed 180° apart, are usually employed. For stack diameters of eight inches to forty-two inches, three equally circumfrentially spaced pilots are customary. For stack diameters between 42 inches and 60 inches, four equally spaced pilots are customary. For stack diameters above 60 inches, five, six, seven or more equally spaced pilots are employed depending upon the diameter of the stack.

No provision, to my knowledge, has heretofore been made for selective activation of pilots dependent either on wind direction or wind velocity, with reduction in the number of pilots, and consequent reduction in gas consumption.

SUMMARY OF THE INVENTION

In accordance with the invention and for use with flare stacks having a plurality of pilots for igniting and retaining ignition of waste combustible gas delivered from the stack, the direction of the wind is utilized to determine which pilot or pilots are to be supplied with gas and activated, flame for ignition being supplied in one form of the invention to a pilot supplied with gas and in another form to all pilots whether or not they are supplied with gas, and with further control dependent on the wind velocity of the quantity of gas supplied to the activated pilot or pilots.

It is the principal object of the invention to provide a multiple pilot system for effecting combustion of combustible waste gas from a flare stack in which the pilot or pilots most effective for initiating or retaining combustion are activated, the remaining pilots being out of action.

It is a further object of the intention to provide a pilot control system in which a wind direction responsive device is utilized to control pilot activation.

It is a further object of the invention to provide a pilot control system in which a wind velocity responsive device is utilized to control pilot activation.

It is a further object of the invention to provide a pilot control system in which the condition prevailing at a pilot is utilized for pilot control.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Reference has been made above to the use of a plurality of gas pilots, dependent upon the diameter of the stack. If two pilots are provided and only a selected one is activated, then a pilot gas saving of 50 percent would result; if three pilots are provided and only a selected one is activated, then a pilot gas saving of 66⅔ percent would result; if four pilots are provided and only a selected one is activated, then a pilot gas saving of 75 percent would result. Greater savings would result if only a selected one of five or more pilots is activated.

Figure 1:
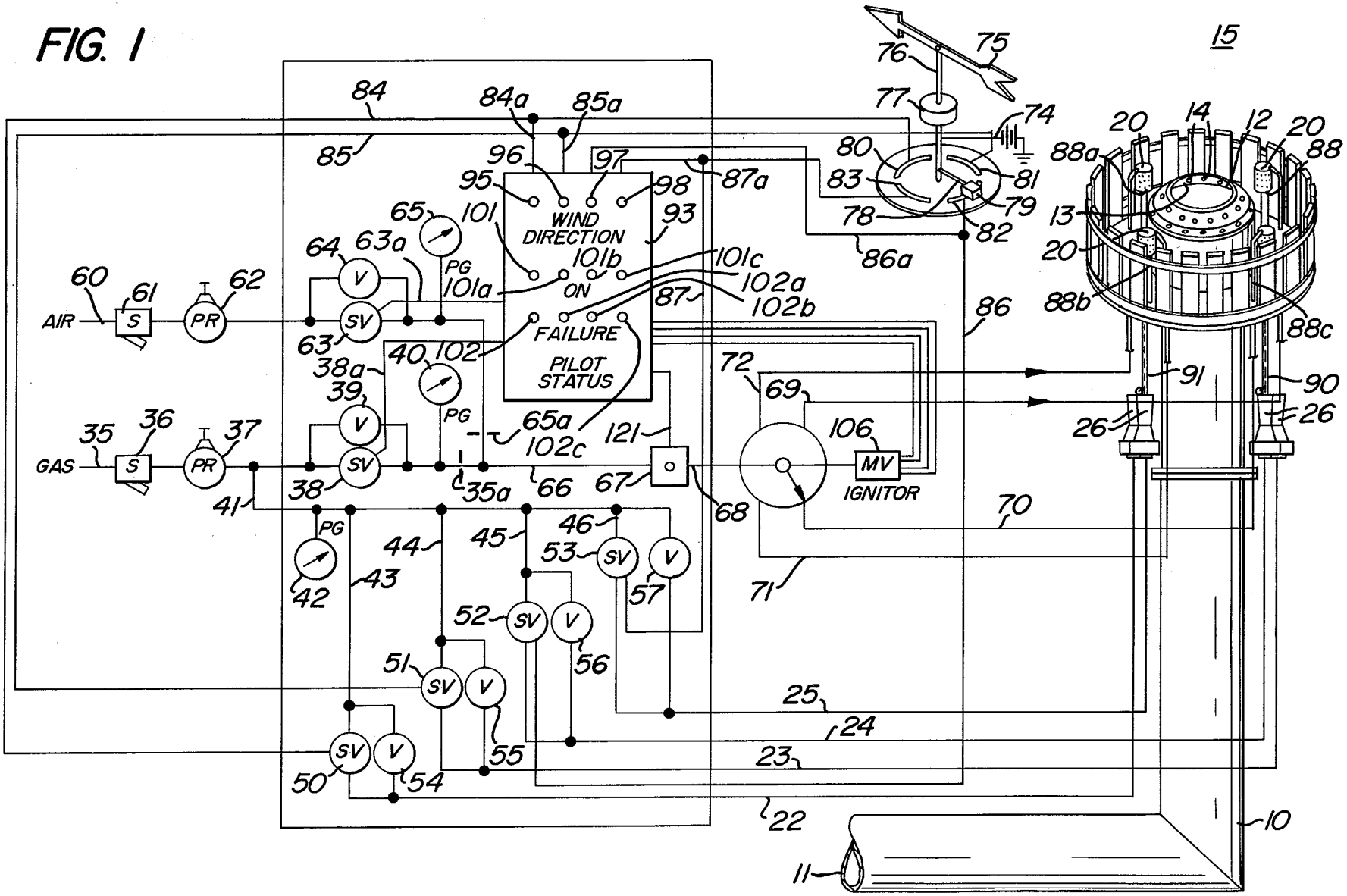
FIG. 1 is a diagrammatic view of a preferred form of pilot system in accordance with the invention.
Figure 2:
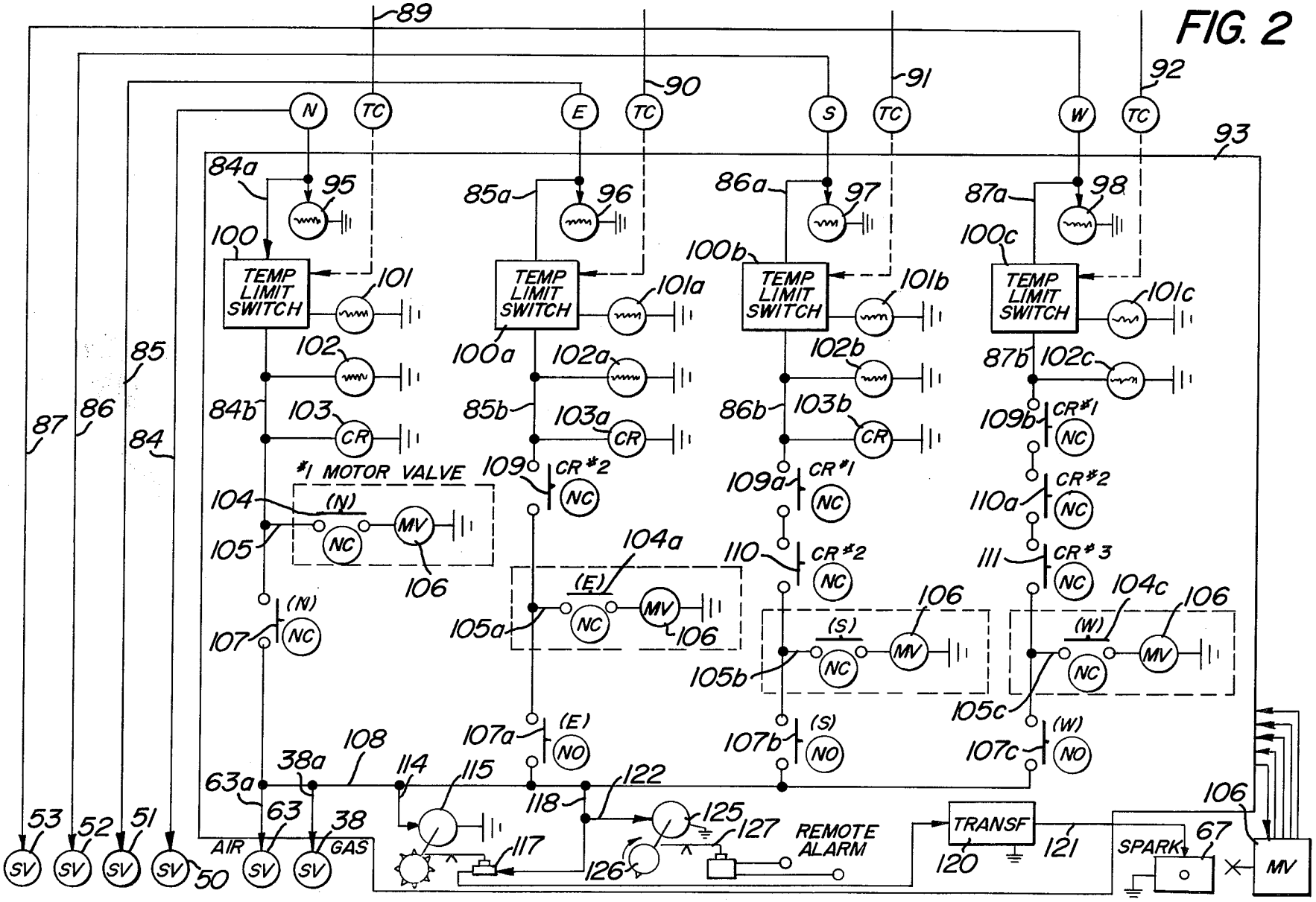
FIG. 2 is a diagrammatic view of a portion of the pilot system of FIG. 1 which is associated with a control panel which can be employed.

Referring now more particularly to FIGS. 1 and 2 of the drawings, a flare stack 10 is shown diagrammatically to which waste combustible gas is supplied through a waste gas main 11. The stack 10 is shown as having a flat burner ring 12 at the top with a frusto-conical inner ring 13 extending therefrom provided with openings 14 for discharge of gas for flame retention. A hollow cylindrical slatted windshield 15 closed at the bottom is shown at the top of the stack 10 to protect the pilots 20 and the burner ring 12.

For purposes of illustration, four pilots 20, are illustrated equally spaced around the circumference of the stack 10 and between the stack 10 and the windshield 15. A greater or lesser number of pilots 20 can be employed dependent upon the diameter of the stack 10 as referred to above.

Each of the pilots 20 has a gas supply pipe 22, 23, 24, or 25 connected thereto, through a venturi 26 for inducing air to support its pilot flame.

Each of the pilots 20 also has an igniter pipe 69, 70, 71 or 72 connected thereto for delivery of an igniter flame to the respective pilot 20 as hereinafter explained.

A combustible gas supply pipe 35 is provided connected through a strainer 36 and an adjustable pressure regulator 37 to a solenoid controlled valve 38. A manually operable bypass valve 39 is connected around the valve 38 for use in the event of control system breakdown. The pipe 35 also has a pressure gage 40 downstream of the valves 38 and 39 for observation of the delivered gas pressure and an orifice **35*a*** therein.

The pipe 35, upstream of the valves 38 and 39, has a gas delivery pipe 41, with a pressure gage 42 thereon connected thereto from which branch pipes 43, 44, 45 and 46 extend through solenoid controlled valves 50, 51, 52 and 53 to the pipes 22, 23, 24 and 25 for supplying gas to the pilots 20 through the venturis 26.

The solenoid controlled valves 50, 51, 52 and 53 have manually operable bypass valves 54, 55, 56 and 57 connected therearound for use in the event of control system breakdown.

An air supply connection 60 is provided, connected to a supply of air under pressure and through a strainer 61 and adjustable pressure regulator 62 to a solenoid controlled valve 63. A manually operable bypass valve 64 is connected around the valve 63 for use in the event of control system breakdown. The connection 60 also has a pressure gage 65 downstream of the valves 63 and 64 for observation of the delivered air pressure.

The pipes 35 and 60 are connected through orifices 35*a* and 65*a* to a pipe 66 for delivery of air and gas for mixing in a flammable mixture for ignition by an igniter 67 such as a spark plug and for distribution of the flame through a pipe 68 and selected flame delivery pipe 69, 70, 71 or 72 to the desired pilot 20.

A wind direction responsive device 75, such as a weather vane, is provided, preferably located contiguous to the top of the stack 10 so as to be responsive to the direction of the wind at the top of the stack.

The weather vane 75 has a vertical shaft 76, rotatably supported in a suitable support 77 which activates a contact arm 78 having a contact 79 for engagement preferably with one of a plurality of segments, one for each of the pilots. For four pilots 20, four segments 80, 81, 82 and 83 are provided. The shaft 76 preferably has suitable source of electrical energy 74 connected thereto to energize, through the contact 79, one of the segments 80, 81, 82 or 83 in accordance with the pilot 20 to be activated. The segments 80, 81, 82 and 83 have signal conductors 84, 85, 86 and 87 respectively connected thereto.

Each of the pilots 20 is preferably provided with a temperature responsive element 88, 88*a*, 88*b* and 88*c* for the determination of whether the pilot 20 to which it is attached is operating, the temperature responsive elements 88, 88*a*, 88*b* and 88*c* for each pilot 20 providing a signal through lines 89, 90, 91 and 92 for use in the control system.

Referring now to FIG. 2, the details of the control system associated with an indicating and control panel 93 are there shown.

The conductor 84 extends to the solenoid valve 50 and has a branch line 84*a* extending to the panel 93 with an indicating lamp 95 which is illuminated if the branch line 85*a* is energized.

The conductor 85 extends to the solenoid valve 51 and has a branch line 85*a* extending to the panel 93 with an indicating lamp 96 which is illuminated if the branch line 85*a* is energized.

The conductor 86 extends to the solenoid valve 52 and has a branch line 86*a* extending to the panel 93 with an indicating lamp 97 which is illuminated if the branch line 86*a* is energized.

The conductor 87 extends to the solenoid valve 53 and has a branch line 87*a* extending to the panel 93 with an indicating lamp 98 which is illuminated if the branch line 87*a* is energized.

The conductor 84*a* extends to a temperature limit switch 100 to which the thermocouple conductor 89 from the thermocouple 88 also extends. If the pilot 20 is operating, the signal through the conductor 89 is effective to illuminate an indicating lamp 101, preferably green in color. If no signal is available, the indicating lamp 102 is illuminated by conductor 84*b*, that lamp preferably being red in color.

The conductor 84*b* also extends to the winding 103 of control relay No. 1 for energizing the same, to a normally closed contact 104 in a conductor 105 acuated at a control position of a motor valve 106 to control delivery of ignitor flame to the flame delivery pipe 69, and to a normally open contact 107 which is moved when the contact 104 is moved, and to a common conductor 108.

The conductor 85*a* extends to a temperature limit switch 100*a* to which the thermocouple conductor 90 from the thermocouple 88*a* also extends. If the pilot 20 is operating, the signal through the conductor 90 is effective to illuminate an indicating lamp 101*a* preferably green in color. If no signal is available, the indicating lamp 102*a* is illuminated by conductor 85*b* that lamp preferably being red in color.

The conductor 85*b* also extends to the winding 103*a* of control relay No. 2 for energizing the same, to a normally closed contact 104*a* in a conductor 105*a* acuated at a control position of the motor valve 106 to control delivery of ignitor flame to the flame delivery pipe 70, and to a normally open contact 107*a* which is moved when the contact 104*a* is moved, and to a common conductor 108.

The conductor 85*b* also has therein a normally closed contact 109 which is open upon energization of the winding 103 to prevent energization of the motor valve 106 through the contact 104*a*.

The conductor 86*a* extends to a temperature limit switch 100*b* to which the thermocouple conductor 91 from the thermocouple 88*b* also extends. If the pilot 20 is operating the signal through the conductor 91 is effective to illuminate an indicating lamp 101*b* preferably green in color. If no signal is available, the indicating lamp 102*b* is illuminated, that lamp preferably being red in color.

The conductor 86*b* also extends to the winding 103*b* of control relay No. 3 for energizing the same, to a normally closed contact 104*b* in a conductor 105*b* actuated at a control position of the motor valve 106 to control delivery of ignitor flame to the flame delivery pipe 71 and to a normally open contact 107*b* which is moved when the contact 104*b* is moved, and to a common conductor 108.

The conductor 86*b* also has therein normally closed contacts 109*a* and 110 which are opened when either of the windings 103 or 103*a* is energized to prevent the energization of the motor valve 106 through the contact 104*b*.

The conductor 87*a* extends to a temperature limit switch 100*c* to which the thermocouple conductor 92 from the thermocouple 88*c* also extends. If the pilot 20 is operating, the signal through the conductor 92 is effective to illuminate an indicating lamp 101*c*, preferably green in color. If no signal is available, the indicating lamp 102*c* is illuminated, that lamp preferably being red in color.

The conductor 87*b* also extends to a normally closed contact 104*c* in a conductor 105*c* actuated at a control position of a motor valve 106 to control delivery of ignitor flame to the flame delivery pipe 72, and to a normally open contact 107*c* which is moved when the contact 104*c* is moved, and to a common conductor 108.

The conductor 87b also has therein normally closed contacts 109b, 110a, and 111 which are opened when any of the windings 103, 103a, or 103b is energized to prevent energization of the motor valve 106 through the contact 104c.

Upon energization of the conductor 108, the solenoid valve 38 is opened and the solenoid valve 63 is opened for delivery of pilot gas and air through the supply pipes 35 and 60.

Upon energization of the conductor 108 an interrupter motor 115 is energized through a conductor 114 to drive a toothed wheel 116 which actuates make and break contacts 117 in a conductor 118 which is connected through a step up transformer 120 in conductor 121 to the spark plug 67.

The conductor 118 can also have connected thereto by a conductor 122 an alarm motor 125 which drives a toothed wheel 126 which actuates make and break contacts 127 to control energization of a remote alarm (not shown).

The motor valve 106, and the contacts associated with it, while shown at the panel 93, are preferably separated and located with the appropriate flame supply and delivery pipes which the motor valve 106 controls.

Figure 3:
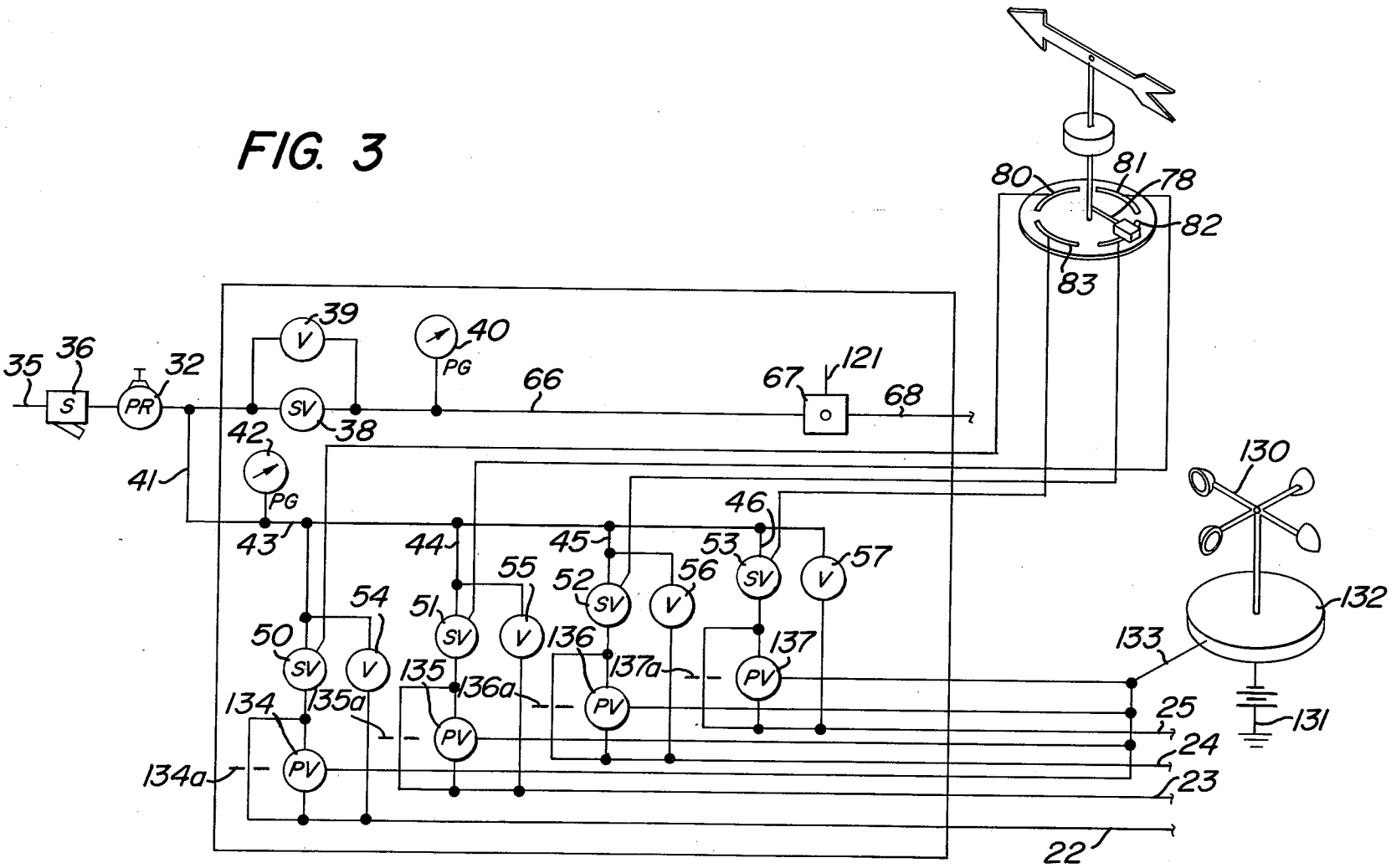
FIG. 3 is a diagrammatic view of a pilot system similar to that of FIGS. 1 and 2 in which the wind velocity adjacent the stack is utilized for modifying the pilot action.

Referring now more particularly to FIG. 3, a modified form of the invention is there illustrated in which the wind speed contiguous to the top of the stack 10 is used for control purposes.

An anemometer 130 is provided rotatably responsive to wind speed, with a power supply 131 connected thereto and with a transmitter 132 for transmitting a signal preferably proportional to the wind speed through a conductor 133.

In series with the valves 50, 51, 52 and 53, proportional control valves 134, 135, 136 and 137 are provided to which the conductor 133 is connected. The signals from the transmitter 132 are effective at the valves 134, 135, 136 and 137 for reducing the flow through the supply pipes 22, 23, 24 and 25 upon decrease in the wind speed and for increasing the flow upon increase in wind speed up to a desired level. The valves 134, 135, 136 and 137 have bypasses 134a, 135a, 136a and 137a therearound for permitting a limited flow sufficient to maintain the pilots at low levels.

In this manner, additional savings of pilot gas are effected when the wind velocity is such that a smaller pilot flame will suffice.

The manually operable bypass valves 54, 55, 56 and 57 respectively bypass the valves 50 and 134, 51 and 135, 52 and 136, and 53 and 137.

Figure 4:
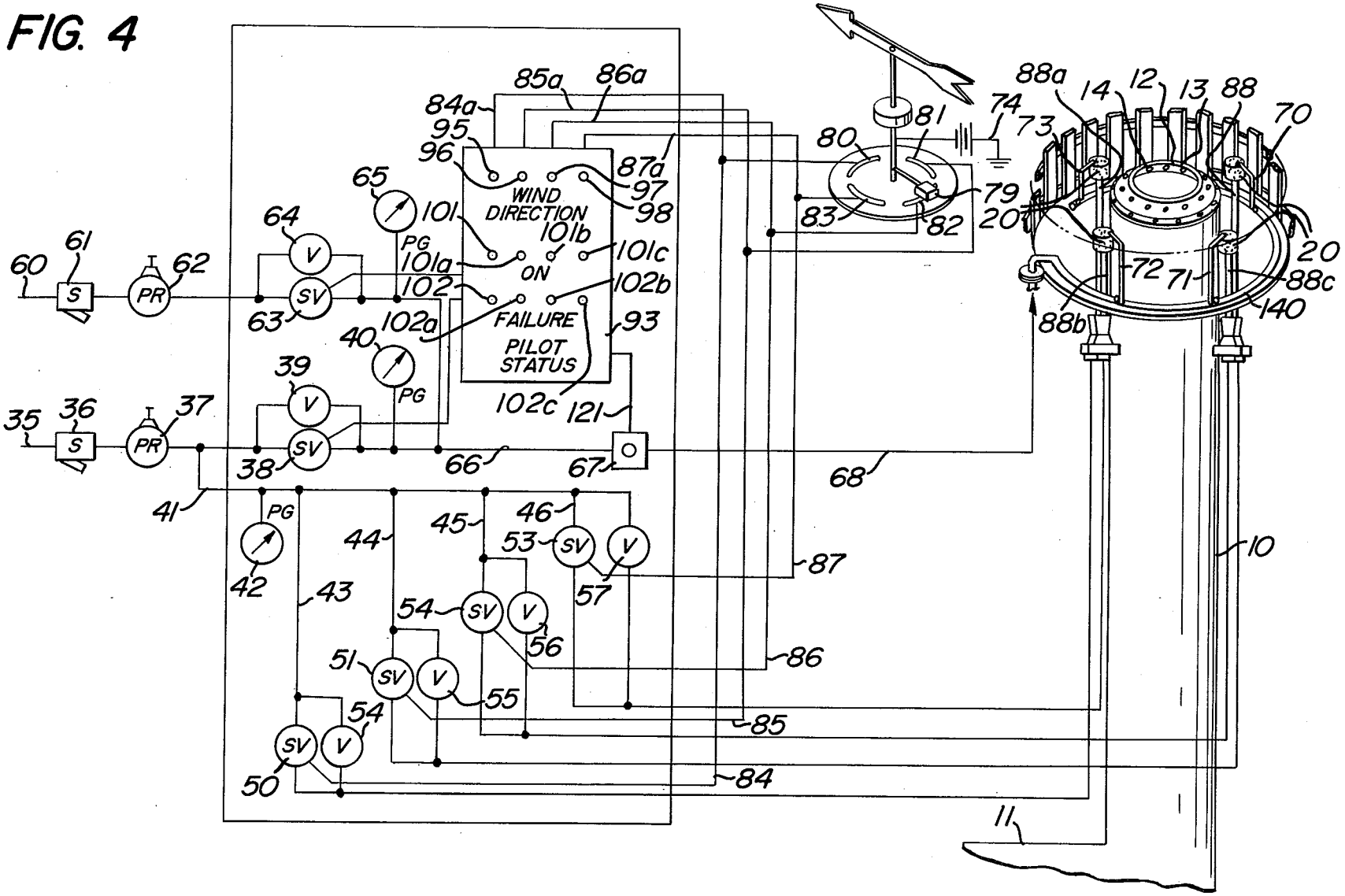
FIG. 4 is a diagrammatic view of a pilot system similar to that of FIG. 1 but in which a simplified ignition arrangement is shown for the pilots.
Figure 5:
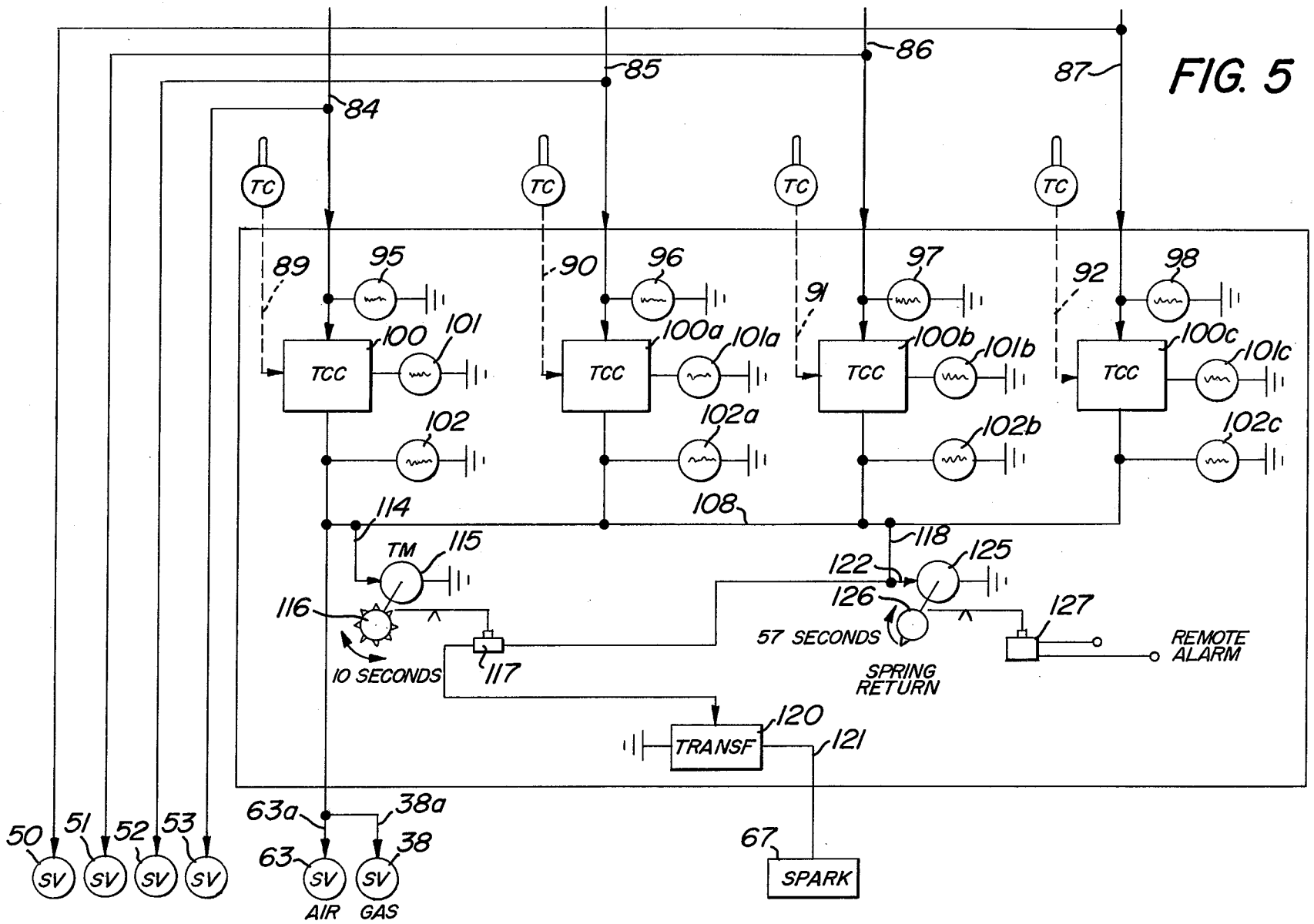
FIG. 5 is a diagrammatic view of the structure associated with the control panel in FIG. 4.

Referring now to FIGS. 4 and 5, the system shown in FIG. 4 is similar to that of FIGS. 1 and 2 but with simultaneous supply of ignitor flame to all the pilots 20 whether or not pilot gas is being supplied thereto.

The supplying of the ignitor flame is effected by connecting the pipe 68 directly to a manifold 140 preferably near the top of the stack from which the ignitor pipes 69, 70, 71 and 72 extend to the respective pilots 20.

In FIG. 5, the portion of the control system for FIG. 4 at the control panel is illustrated and which is similar to FIG. 2 except that the elmination of the separate ignitor flame control permits of much simplification.

The conductors 84, 85, 86 and 87 are shown as are the temperature signal conductors 89, 90, 91 and 92 and these are connected as previously described. The conductors 84a, 85a, 86a and 87a are connected to wind direction indicator lamps 95, 96, 97 and 98 and to the limit switches 100, 100a, 100b and 100c to which the signal conductors 89, 90, 91 and 92 and the green indicator lamps 101, 101a, 101b are also connected and to the red indicator lamps 102, 102a, 102b and 102c and common conductor 108, as determined by the positioning of the limit switches 100, 100a, 100b and 100c.

The common conductor 108 has the conductors 38a and 63a to the solenoid valves 38 and 63 and the conductors 114 and 118 connected thereto as previously described.

Figure 6:
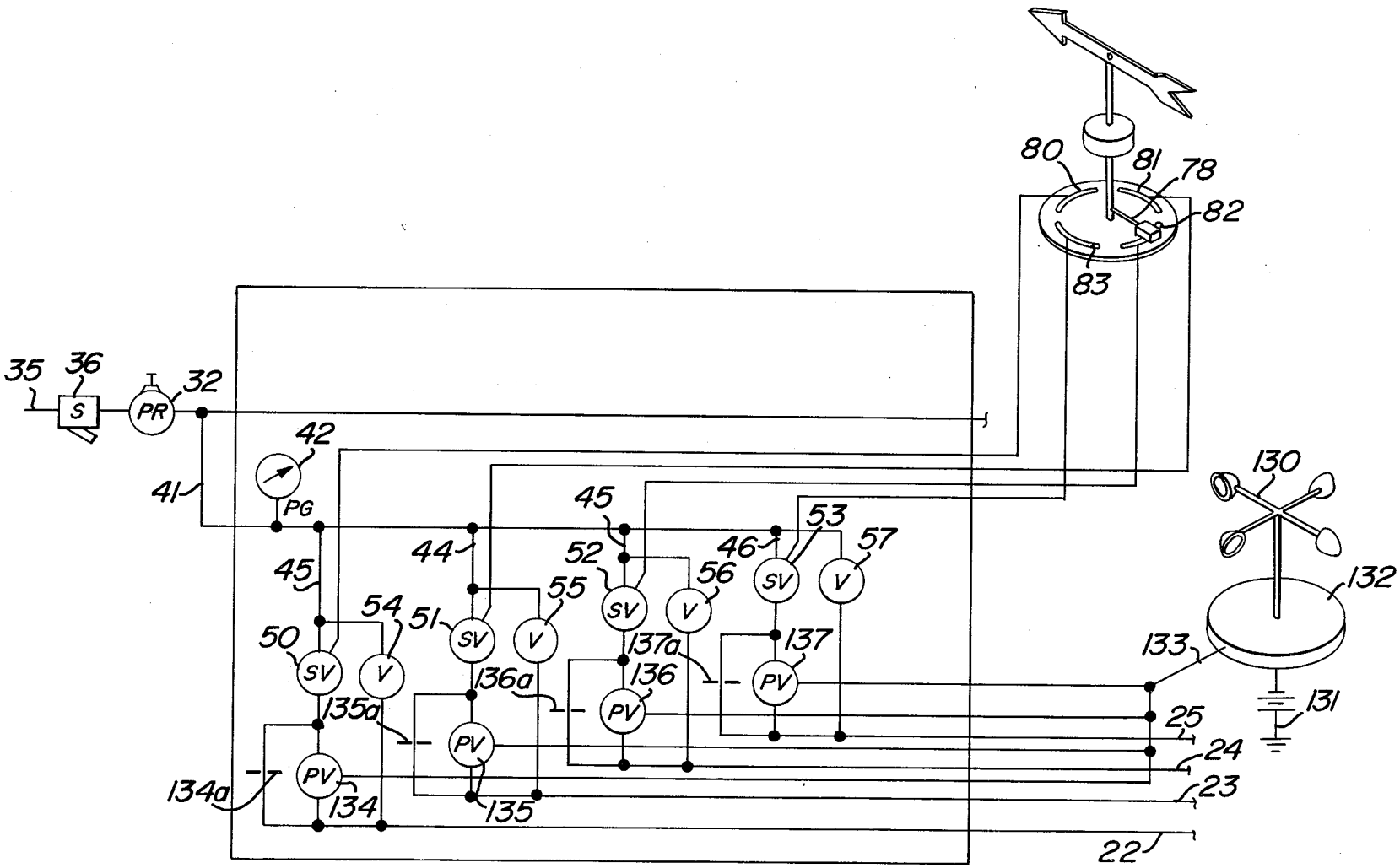
FIG. 6 is a diagrammatic view of a pilot system similar to that of FIGS. 4 and 5 in which the wind velocity adjacent the stack is utilized for modifying the pilot action.

In FIG. 6, a modified form of the invention is there shown wherein the wind speed contiguous to the top of the stack is shown as applied to the form of the invention illustrated in FIGS. 4 and 5.

An anemometer 130 is provided, as illustrated in FIG. 3, with a power supply 131 and signal transmitter 132 as before, for transmitting a signal preferably proportional to the wind speed through a conductor 133 for controlling proportional valves 134, 135, 136 and 137 for reducing the flow of gas with attendant gas savings, through the supply pipes 22, 23, 24 and 25 upon decrease in the wind speed and increasing the flow upon increase in wind speed. Bypasses 134a, 135a, 136a and 137a are effective as before.

The mode of operation will now be summarized briefly.

Assume that air under pressure is available at the air supply connection 60, that combustible gas for pilot operation is available at the gas supply connection 35 and that waste combustible gas is supplied through the gas main 11 to the stack 10 for burning at and beyond the burner ring 12. Air will be supplied as controlled by the solenoid valve 63 for admixture with pilot gas as controlled by the solenoid valve 38 for delivery through the mixing pipe 66 for ignition by the spark plug 67 and flame delivery through the pipe 68 and to an appropriate flame pipe 69, 70, 71 and 72 as determined by the positioning of the motor valve 106.

Pilot gas will also be delivered through supply pipes 43, 44, 45 and 46, to pilot gas supply pipes 22, 23, 24 and 25, as controlled by the solenoid valves 50, 51 and 52 and 53.

The wind direction responsive device or weather vane 75 will be positioned by the prevailing wind. For purposes of illustration, this is assumed to be from the west to the east and positions the vane 75 as shown in FIGS. 1, 3, 4 and 6. This will position the contact 79 in engagement with the segment 81. A signal will be available from the power source 74 through the segment 81 and conductor 85 to activate the solenoid valve 51, to supply pilot gas and through the pilot gas supply pipe 23 to the pilot 20 located downstream of the wind direction, in this instance at the west.

At the same time the signal in the conductor 85a will cause the wind direction lamp 96 to be illuminated, an indication will be available at the lamps 101a or 102a, dependent upon the temperature signal from the temperature responsive element at that pilot 20 as sent to the limit switch 100a. The signal in the conductor 85b will be effective to energize the winding 103a of the control relay No. 2 which will deactivate the circuits which include 86a and 87a at the contacts 110 and 110a. The signal in the conductor 85b will also act through the normally closed contacts 109 and 104a to cause the motor valve 106 to move to a position for delivery of igniting flame through the flame pipe 70 at which location the contact 104a is opened to discontinue further motor movement and the contact 107a closed to supply a signal to the common conductor 108.

Energization of the conductor 108 is effective through lines 38*a* and 63*a* to activate the solenoid valves 38 and 63 to open positions, and is effective through the conductor 114 to activate the interrupter motor 115 to interrupt the current supplied through conductor 118 and transformer 120 to the spark plug 67.

If the wind is from a different direction, then signals will be available respectively from the segmental conductors 80, 82 or 83 with corresponding signals through the conductors 84, 86 or 87 and with energization of the conductors 84*a*, 86*a* or 87*a* and the elements controlled thereby.

If the contact 79 straddles two contiguous segmental conductors, such as 80 and 81, then two adjacent pilots 20 will be activated.

The operation of the systems shown in FIGS. 3 and 4 is similar to that of FIGS. 1 and 2 and with the elimination of the motor valve 106 direct pilot igniting flame delivery is effected from the spark plug 67 through the flame pipe 68 to the manifold 140 and flame delivery pipes 69, 70, 71 and 72 although only one pilot 20 is supplied with pilot gas in the manner previously explained.

Referring now to FIGS. 3 and 6, if the anemometer 130 is employed as therein illustrated, the gas supplied to the wind direction controlled pilots 20 is controlled by the signal from the signal transmitter 132 to the proportional control valves 134, 135, 136 and 137 which control delivery to the pilot gas supply pipes 22, 23, 24 and 25, reducing the flow when the wind velocity is low and increasing the flow up to a predetermined maximum when the wind velocity is higher and with a tendency to flatten the flames from the pilot 20. The bypasses 134*a*, 135*a*, and 137*a* provide for limited flow for operation of the wind direction controlled pilots.

I claim:

1. A control system for the pilots of a waste combustible gas flare burner having a plurality of pilots which comprises a connection to a supply of pilot gas, a plurality of spaced pilots for said flare burner connected to said supply connection, and means for controlling the supply of pilot gas to said pilots comprising a wind direction responsive member contiguous to said flare burner, and valve members for each of said pilots controlled by the positioning of said wind direction responsive member.

2. A control system as defined in claim 1 comprising visual indicating means responsive to the positioning of said wind direction responsive member.

3. A control system as defined in claim 1 comprising pilot condition responsive means for each of said pilots, and visual indicating means responsive to said pilot condition responsive means.

4. A control system as defined in claim 1 in which said wind direction responsive member has a contact member movable therewith, a plurality of fixed contact members are provided, one for each of said pilots, for engagement by said movable contact member, and control means from each of said fixed contact members to a corresponding one of said valve members.

5. A control system as defined in claim 1 in which igniters are provided for each of said pilots, and means for actuating said igniters.

6. A control system as defined in claim 5 in which said igniters include means for supplying flame thereto.

7. A control system as defined in claim 6 in which control means is provided for supplying igniter flame to a pilot to which pilot gas is supplied.

8. A control system as defined in claim 7 in which said control means includes a motor operated valve.

9. A control system as defined in claim 8 in which said motor operated valve is positioned by signals corresponding to the location of a pilot to which pilot gas is supplied.

10. A control system as defined in claim 6 in which control means is provided for supplying igniter flame to each of said pilots.

11. A control system as defined in claim 1 in which said means for controlling the supply of pilot gas to said pilots comprises a wind speed responsive member.

12. A control system as defined in claim 10 in which control valve members are provided for each of said pilots, and said control valve members are controlled by said wind speed responsive member.

13. A control system for the pilot gas for a waste combustible gas flare burner having a plurality of pilots which comprises a flare gas burner, a connection to a supply of pilot gas, a plurality of spaced pilots adjacent said flare burner connected to said supply connection, and means for controlling the supply of pilot gas to said pilots comprising a wind speed responsive member contiguous to the burner, and valve members for each of said pilots controlled by said wind speed responsive member.

14. A control system as defined in claim 13 in which said valve members have proportional controls.

15. A control system as defined in claim 14 in which said valve members have bypass connections for limited continuous supply of pilot gas for maintaining pilot operation.

16. A control system as defined in claim 1 in which manual bypass valves are provided connected around said valve members for operation independent of said control means.

* * * * *

UNITED STATES PATENT OFFICE

CERTIFICATE OF CORRECTION

Patent No. 4,090,840 Dated May 23, 1978

Inventor(s) John F. Straitz, III

It is certified that error appears in the above-identified patent and that said Letters Patent are hereby corrected as shown below:

Column 3,

Line 54, after "line", "85a" should be - 84a - .

Column 7,

Line 34, after "135a," - 136a - should be inserted.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*